US005860054A

United States Patent [19]

Smith et al.

[11] Patent Number: 5,860,054

[45] Date of Patent: Jan. 12, 1999

[54] METHOD FOR IMPROVING FEEDING OF A COMPILATIONS OF RECORDING SHEETS IN PRINTING PROCESS

[75] Inventors: Patricia L. Smith, Webster; Diane M. Foley, Palmyra, both of N.Y.

[73] Assignee: Xerox Corporation, Stamford, Conn.

[21] Appl. No.: 778,129

[22] Filed: Jan. 2, 1997

[51] Int. Cl.[6] ..... G03G 15/00; G03G 21/00

[52] U.S. Cl. ..... 399/393; 399/406

[58] Field of Search ..... 399/393, 406, 399/381

[56] References Cited

U.S. PATENT DOCUMENTS

| | | | |
|---|---|---|---|
| 4,942,435 | 7/1990 | Kneisel et al. | 399/393 |
| 5,359,402 | 10/1994 | Nakahata et al. | 399/393 X |
| 5,414,503 | 5/1995 | Siegel et al. | 399/406 |
| 5,565,970 | 10/1996 | Suda | 399/406 |

FOREIGN PATENT DOCUMENTS

| | | |
|---|---|---|
| 55-103557 | 8/1980 | Japan . |
| 3-081791 | 4/1991 | Japan . |

*Primary Examiner*—Fred L. Braun
*Attorney, Agent, or Firm*—Lloyd F. Bean, II

[57] ABSTRACT

A method for improving feeding of a compilations of recording sheets in a printing process including the steps of forming a stack of the recording sheets having an in-ream curl value between 10 mm to 20 mm from the compilations of recording sheets; loading the stack of recording sheets in a sheet input station; feeding each recording sheet from the stack to a process station, the feeding step includes separating each recording sheet from the stack of recording sheets to be fed to the process station; recording an image on an imageable surface; developing the imaging with marking particles; transferring the developed image onto the recording sheets; and fixing the developed image onto a recording sheet at a fixing station.

2 Claims, 2 Drawing Sheets

METHOD FOR IMPROVING FEEDING OF A COMPILATIONS OF RECORDING SHEETS IN PRINTING PROCESS

BACKGROUND OF THE PRESENT INVENTION

This invention relates generally to an electronic reprographic printing system, and more particularly concerns a recording sheet manufacturing process for improving feeding of compilations of recording sheets that often accompanies this general method of reproduction and printing.

INCORPORATION BY REFERENCE

The following is specifically incorporated by reference US-A(D/96665Q) entitled "A RECORDING SHEET MANUFACTURING PROCESS FOR IMPROVING FEEDING OF COMPILATIONS OF RECORDING SHEETS" filed concurrently herewith.

In the process of electrostatographic reproduction, a light image of an original to be copied is typically recorded in the form of a latent electrostatic image upon a photosensitive member, with a subsequent rendering of the latent image visible by the application of electroscopic marking particles, commonly referred to as toner. The visual toner image can be either fixed directly upon the photosensitive member or transferred from the member to another support medium, such as a sheet of plain paper. To render this toner image permanent, the image must be "fixed" or "fused" to the paper, generally by the application of heat and pressure.

With the advent of high speed xerography reproduction machines wherein copies can be produce at a rate in excess of three thousand copies per hour, the need for a document sheet and sheet handling system to, for example feed document through each process station in a rapid succession in a reliable and dependable manner in order to utilize the full capabilities of the reproduction machine. These sheet handling systems must operate flawlessly to virtually eliminate risk of damaging the recording sheets and generate minimum machine shutdowns due to misfeeds or document multifeeds. It is in the initial separation of the individual document sheets from the document stack where the greatest number of problem occur which, in some cases, can be due to up curl and downcurled in document sheets which generally occurs randomly in the document stack.

A simple, relatively inexpensive and accurate approach to manufacture document sheets having improved sheet feeding performance in a xerographic type reproduction machines has been a goal in the design, manufacture and use of xerographic printers. The need to provide accurate approach to manufacture document sheets having improve sheet feeding has become more acute when feeding documents having a glossy coatings thereon such as Xerox Ultra Spec Gloss Coated Paper.

Briefly, the present invention obviates the problems due to misfeeds or document multifeeds by utilizing a document sheets having an in-ream curl 10–20 mm.

Pursuant to one aspect there is provided a recording sheet manufacturing process for improving feeding of compilations of recording sheets that often accompanies this general method of reproduction and printing is disclosed. It has been found that having 50 to 100 percent of recording sheets in a stack having in-ream curl from 10–20 mm exhibit improved sheet feeding, particularly in situations wherein a recording sheet is in initial separated from the document stack. A method for manufacturing a plurality of recording sheets to control an amount of in-ream curl subsequent to cutting the web in to a plurality of sheets, includes the steps of: wetting a first planar surface of the web and a second planar surface of the web; maintaining said second planar surface of the web wetter than said first planar surface of the web; coating said first planar surface of the web with a coating solution; drying said first planar surface of the web and said second planar surface of the web, said drying step comprising heating said first planar surface of the web to a first temperature and heating said second planar surface of the web to a second temperature; coating said second planar surface of the web with a coating solution; and drying said second planar surface of the web until the web is dry.

DESCRIPTION OF THE INVENTION

Figure 1:
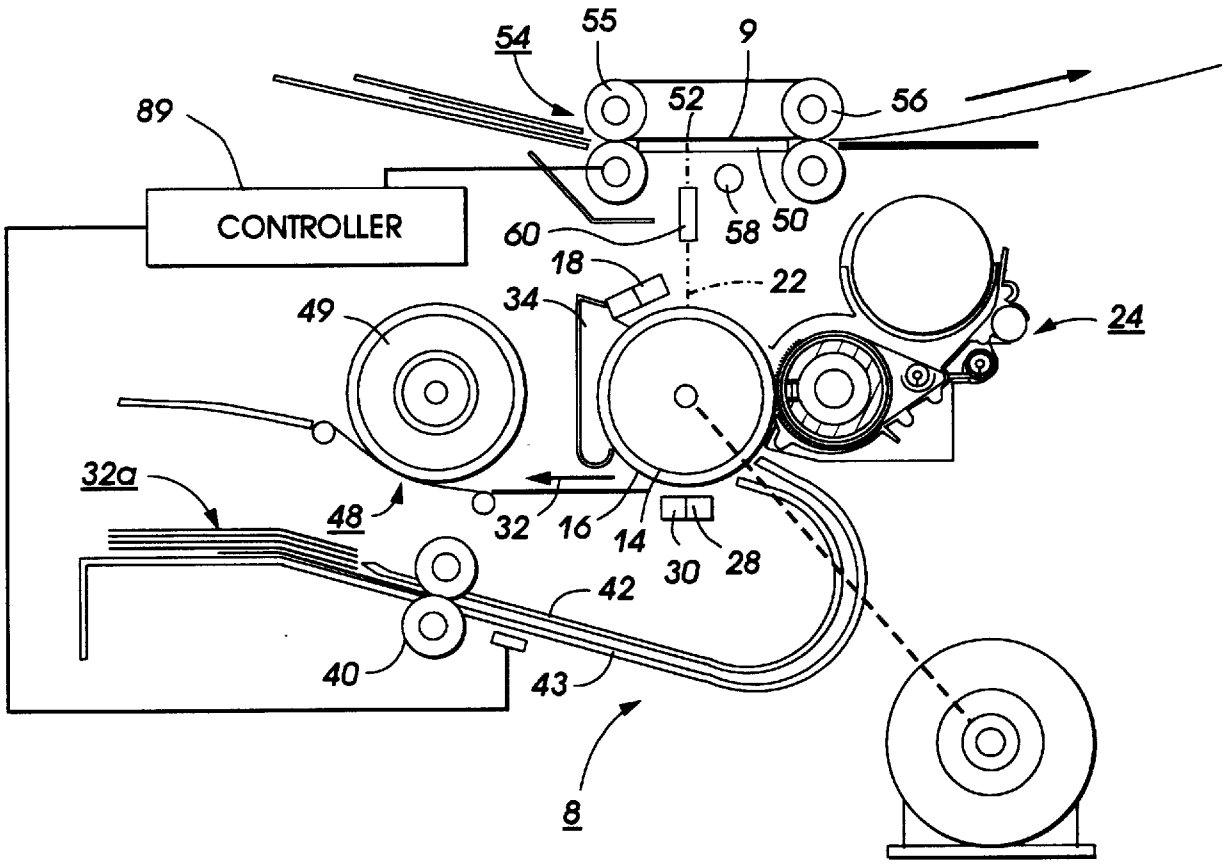
FIG. 1 is a side view, is section, of a xerographic reproduction machine incorporating of the present invention.

Referring to FIG. 1 of the drawings, there is shown a xerographic type reproduction machine 8 incorporating the magnetic brush of the present invention, designated generally by the numeral 80. Machine 8 has a suitable frame (not shown) on which the machine xerographic components are operatively supported. Briefly, and as will be familiar to those skilled in the art, the machine xerographic components include a recording member, shown here in the form of a rotatable photoreceptor 14. In the exemplary arrangement shown, photoreceptor 14 comprises a drum having a photoconductive surface 16. Operatively disposed about the periphery of photoreceptor 14 are a charge corotron 18 for placing a uniform charge on the photoconductive surface 16 of photoreceptor 14; an exposure station 22 where the previously charged photoconductive surface 16 is exposed to image rays of a document 9 being copied or reproduced; development station 24 where the latent electrostatic image created on photoconductive surface 16 is developed by toner; and transfer detack corotrons 28 and 30 for assisting transfer of the developed image to a suitable recording substrate material such as a recording sheet 32 brought forward in timed relation with the developed image on photoconductive surface 16. Residual toner is removed from the drum surface at cleaning station 34.

Recording sheets 32 are brought forward to the transfer area by feed roll pair 40, sheet guides 42, 43 serving to guide the sheet through an approximately 180° turn prior to the transfer area. Following transfer, the sheet 32 is carried forward to a fusing station 48 where the toner image is fixed by fusing roll 49. After fusing, the recording sheet 32 is discharged to an output tray.

Figure 2:
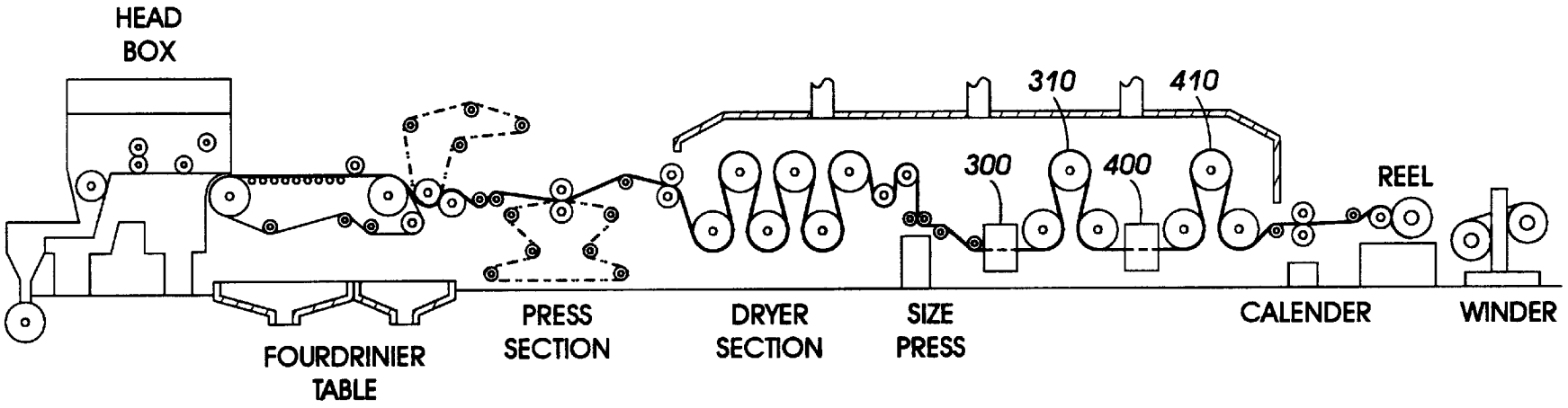
FIG. 2 is a process schematic illustrating the web coating process employed with the present invention.

Referring to FIG. 2, the recording sheets of the present invention are manufactured with a paper machine. Briefly, and as will be familiar to those skilled in the art, the paper machine components include which is well known in the art.

The headbox delivers the mixture of fibers and water to the moving wire of the paper machine. Here a control device, called the "slice", can be moved up and down allowing the operator to regulate the amount of pulp flowing onto the wire. The headbox delivers the entire flow of pulp and water evenly onto the wire, while the slice ensures an even caliper across the sheet.

The Fourdrinier table consists essentially of an endless mesh belt which is supported by the rollers, and other devices, which make up the wet end of the paper machine. The stock flows through the slice onto the mesh, which rotates over the Fourdrinier table. Then as the vibrating action of the shake takes hold, the fibers are re-aligned in a purposely haphazard direction on the Fourdrinier table.

Located after the foils on the Fourdrinier table are the suction boxes which remove water from the sheet by gently applying suction to the underside of the wire.

Watermarks are impressed into the sheet by means of a dandy roll (not shown) which has raised characters in the shape of the chosen design. This wire-covered roll rides on the sheet of paper over one of the suction boxes.

The couch roll (not shown) is a metal cylinder with a perforated shell, equipped internally with a vacuum box (not shown), which removes more moisture form the sheet. This motor driven roll supplies the power to the Fourdrinier wire, which, in turn, drives the other rolls.

The newly-formed paper, leaving the wire, is very bulky and weak, because it is still 75% to 80% water.

Paper and felt are now passed into an area of the paper machine known as the press section, which includes the suction and smoothing presses. Most paper machines have at least two presses; the suction press further removes moisture from the paper, while the smoothing press gives the paper a uniform surface.

On most paper machines, the three sections of dryer cans, with about 15 to 20 dryers in each, are totally enclosed by an insulated hood. The first section, nearest the wet end of the paper machine, runs at a speed a little greater than that of the suction presses to maintain tension on the sheet. The second and third directions also run at slightly increased speeds over the previous section, and there may be a speed differential of as much as 10% between the Fourdrinier wire and the last dryer.

Surface or external sizing agents, such as resins, glue or starch, are applied by means of a size press, to paper or board to increase its water—or ink—resistance, to eliminate fuzz and abrasiveness, and to improve its printing properties and surface bonding strength. After the size presses the paper coaters 300 and 400 coat the paper utilizes the method of the present invention which will be discussed in greater detail supra.

The calendar stack is used to smooth the surface of the paper and to remove the differences in caliper across the sheet. The degree of finish is governed by the pressure applied between the cast-steel cylinders (not shown) through which the paper is passed. From the calendar, the rolls of paper are passed onto the constant-tension reel winder. These rolls are subsequently removed for slitting and rewinding.

To summarize, from the headbox the mass of fibers and water is forced past the slice, where grain direction is given on the Fourdrinier wire. Thirty percent of the water is drawn through the wire by foils, suction boxes and the couch roll. Next, the web of paper passes through the press section and on to dryers. Surface sizing agents are applied at the size press during the drying process. Coming from the dryers, the paper is passed through calendar stack which gives a smooth finish to the paper. After the roll is removed from the reel, it is cut by slitters to various width requirements into sheet form.

The recording sheets of the present invention comprise a substrate sized blends of hardwood kraft and softwood kraft fibers containing from about 10 to 90 percent by weight soft wood and from about 10 to about 90 percent by weight hardwood. Examples of hardwood include Seagull W dry bleached hardwood kraft, present in one embodiment in an amount of about 70 percent by weight. Examples of softwood include La Tuque dry bleached softwood kraft, present in one embodiment in an amount of about 30 percent by weight. These substrates can also contain fillers and pigments in any effective amounts, typically from about 1 to about 60 percent by weight, such as clay (available from Georgia Kaolin Company, Astro-fil 90 clay, Engelhard Ansilex clay), titanium dioxide (available from Tioxide Company—Anatase grade AHR), calcium silicate CH-427-97-8, XP-974 (J.M. Huber Corporation), and the like. The sized substrates can also contain sizing chemicals in any effective amount, typically from about 0.25 percent to about 25 percent by weight of pulp, such as acidic sizing, including Mon size (available from Monsanto Company), alkaline sizing such as Hercon-76 (available from Hercules Company), Alum (available from Allied Chemicals as Iron free alum), retention aid (available from Allied Colloids as Percol 292), and the like. Preferred basis weights for the substrate are from about 40 to about 400 grams per square meter, although the basis weight can be outside of this range. The substrate can be of any effective thickness. Typical thickness for substrates are from about 50 to about 500 microns, and preferably from about 100 to about 125 microns, although the thickens can be outside this range.

Referring to the present invention in greater detail, a coating solution is applied to the substrate by any suitable technique, such as size press treatment, dip coating, reverse roll coating, extrusion coating, or the like. The coating solution comprises structured clay, calcium carbonate, dispersant, binder, Titanium Dioxide, plastic pigment, thickener, latex, lubricant, wet strength resin, dyes, and defoamer.

In dip coating, a web of the material to be coated is transported below the surface of the liquid coating composition by a single roll in such a manner that the exposed site is saturated, followed by removal of any excess coating by the squeeze rolls and drying in an air dryer. The liquid coating composition generally comprises the desired coating composition dissolved in a solvent such as water, methanol, or the like. The method of surface treating the substrate using a coater results in a continuous sheet of substrate with the coating material applied first to one side and then to the second side of this substrate. The substrate can also be coated by a slot extrusion process, wherein a flat die is situated with the die lips in close proximity to the web of substrate to be coated, resulting in a continuous film of the coating solution evenly distributed across one surface of the sheet, followed by drying in an air dryer.

Referring to FIG. 2, in the present invention the paper web passes through coater 300 and 400. In coater 300 coating solution is applied to wet the surface of the surface of the web. After the web moves through the first coater, the sheet is dried until the moisture content of the web is between 0% and 4% but preferably 3%. The web then moves into coater 400 were the felt side is coated, then dryer 410 is adjusted such that the steam pressure differential in the felt side cans is +5–+10 psi compared to the steam pressure in the wire side cans, until the moisture content of the web is 3%–4%. The following process results in one side of the coating on the web being harder than the other which results in desirable range of 10–20 mm "in-ream curl" being orientated towards the felt side, after the web is cut into sheets.

Generally, the term "in-ream curl" refers to the amount of curl in mm contained by sheets of paper in a single ream, prior to imaging or printing. It can be determine by finding the distance between the base line of the arc formed by recording sheet when viewed in cross-section across its width (or shorter dimension—for example, 8.5 inches in an 8.5×11 inch sheet, as opposed to length, or longer dimension—for example, 11 inches in an 8.5×11 inch sheet) and the midpoint of the arc. To measure curl, a sheet can be held with the thumb and forefinger in the middle of one of the short edges of the sheet (for example, in the middle of one of the 8.5 inch edges in an 8.5×11 inch sheet) and the arc formed by the sheet can be matched against a pre-drawn standard template curve.

Applicants have found after extensive efforts that having 50 to 100 percent of recording sheets in a stack having in-ream curl from 10–20 mm exhibit improved sheet feeding, particularly in situations wherein a recording sheet is in initial separated from the document stack.

Specific embodiments of the invention will now be described in detail. These examples are intended to be illustrative, and the invention is not limited to the materials, conditions, or process parameters set forth in these embodiments. All parts and percentages are by weight unless otherwise indicated.

EXAMPLE 1

The Example illustrates the use of the invention at the coating and dry end of the papermaking process.

A substrate was made up of sized blends of hardwood kraft and softwood kraft fibers containing (15%–20%) percent by weight soft wood (80%–85%) percent by weight hardwood. Hardwood include Seagull W dry bleached hardwood kraft, softwood include La Tuque dry bleached softwood kraft. The web contains approximately 80% moisture before entering the press section. After the press section, before the dryers, the web contains approximately 65%–75% moisture.

The paper web passes through coater 300 and 400. In coater 300 coating solution is applied to wet the surface of the surface of the web. After the web moves through the first coater, the web is dried until the moisture content of the web is between 0% and 4% but preferably 3%. The web then moves into 30 coater 400 were the felt side is coated, then dryer 410 is adjusted such that the steam pressure differential in the felt side cans is +5–+10 psi compared to the steam pressure in the wire side cans, and the web is dried until the moisture content of the web is 3%–4%. The following process results in the recording sheet had an in ream value 12 mm which were tested in Xerox 5090 xerographic printing machine wherein the environmental condition were 70 F and 60% RH, it was found that it had a normalized jam rate of 2 out 5,000 impressions, actual jam rate of 3 out 6,500 impressions, and had a post fuser curl of 36 mm.

EXAMPLE 2

Recording sheet was prepared as similar as example 1 except for: After the web moves through the first coater, the dryer 310 is adjusted such that there is no differential in steam pressure between the wire side cans and felt side cans, and the web is dried until the moisture content of the web is 4.3%. The web then moves into coater 400 were the felt side is coated, then dryer 410 is adjusted such that there is no differential in steam pressure between the felt side and wire side cans, and the web is dried until the moisture content of the web is 3.0%–4.0%.

The recording sheet had an in ream value 3 mm which were tested in Xerox 5090 xerographic printing machine wherein the environmental condition were 70 F and 60% RH, it was found that it had a normalized jam rate of 16 out 5,000 impressions, actual jam rate of 24 out 7,500 impressions, and had a post fuser curl of 29 mm.

EXAMPLE 3

Recording sheet was prepared as similar as example 1 except for: The top coating was adjusted to contain an increased amount of calcium carbonate. After the web moves through the first coater, the web is until the moisture content of the web is between 0% and 4% but preferably 3%. The web then moves into coater 400 were the felt side is coated, then dryer 410 is adjusted such that the steam pressure differential in the felt side cans is +5–+10 psi compared to the steam pressure in the wire side cans, and the web is dried until the moisture content of the web is 3%–4%.

The recording sheet had an in ream value 19 mm which were tested in Xerox 5090 xerographic printing machine wherein the environmental condition were 70 F and 60% RH, it was found that it had a normalized jam rate of 1 out 5,000 impressions, actual jam rate of 1 out 6,000 impressions, and a post fuser curl of 41 mm.

While the invention has been described with reference to the structure disclosed, it is not confined to the specific details set forth, but is intended to cover such modifications or changes as may come within the scope of the following claims.

What is claimed is:

1. A method for improving feeding of a compilations of recording sheets in a printing process comprising:

forming a stack of said recording sheets having an in-ream curl value between 10 mm to 20 mm from said compilations of recording sheets;

loading the stack of recording sheets in a sheet input station;

feeding each recording sheet from said stack to a process station, said feeding step includes separating each recording sheet from said stack of recording sheets to be fed to the process station;

recording an image on an imageable surface;

developing the imaging with marking particles;

transferring the developed image onto said recording sheets; and fixing the developed image onto a recording sheet at a fixing station.

2. The printing process of claim 1, wherein said each recording sheet has a thickness of from about 3.5 to about 4.2 thousandths of an inch.

* * * * *